US007416368B2

(12) United States Patent
Dagher et al.

(10) Patent No.: US 7,416,368 B2
(45) Date of Patent: Aug. 26, 2008

(54) SHEET PILING PANELS WITH ELONGATED VOIDS

(75) Inventors: Habib J. Dagher, Veazie, ME (US); Roberto A. Lopez-Anido, Orono, ME (US); Douglas J. Gardner, Brewer, ME (US); Matthew J. Dura, Orono, ME (US); Katherine L. Stephens, Orono, ME (US)

(73) Assignee: University of Maine System Board of Trustees, Bangor, ME (US)

( * ) Notice: Subject to any disclaimer, the term of this patent is extended or adjusted under 35 U.S.C. 154(b) by 0 days.

(21) Appl. No.: 11/013,301

(22) Filed: Dec. 15, 2004

(65) Prior Publication Data

US 2005/0163575 A1 Jul. 28, 2005

Related U.S. Application Data

(60) Provisional application No. 60/529,712, filed on Dec. 15, 2003.

(51) Int. Cl.
*E02D 5/02* (2006.01)

(52) U.S. Cl. ..... 405/274; 428/131; 428/188; 428/304.4

(58) Field of Classification Search ..... 405/272–280, 405/284, 285; 52/606, 608; 428/34.1, 36.8, 428/116, 118, 131, 188, 304.4
See application file for complete search history.

(56) References Cited

U.S. PATENT DOCUMENTS

| | | | | | |
|---|---|---|---|---|---|
| 3,416,276 | A | * | 12/1968 | Caputo et al. | 52/436 |
| 4,125,979 | A | * | 11/1978 | McLaughlin | 52/259 |
| 4,259,820 | A | | 4/1981 | Kita et al. | 52/302.3 |
| 4,674,921 | A | | 6/1987 | Berger | 405/262 |
| 4,690,588 | A | | 9/1987 | Berger | 405/262 |
| 5,145,287 | A | | 9/1992 | Hooper et al. | 405/262 |
| 5,292,208 | A | * | 3/1994 | Berger | 405/281 |
| 5,579,620 | A | | 12/1996 | Kuo | 52/447 |
| 5,765,970 | A | * | 6/1998 | Fox | 405/284 |
| 5,881,508 | A | | 3/1999 | Irvine et al. | 52/177 |
| 6,000,883 | A | | 12/1999 | Irvine et al. | 405/281 |
| D420,154 | S | | 2/2000 | Irvine et al. | D25/138 |
| 6,033,155 | A | | 3/2000 | Irvine et al. | 405/281 |
| 6,053,666 | A | | 4/2000 | Irvine et al. | 405/279 |
| 6,309,732 | B1 | | 10/2001 | Lopez-Anido et al. | 428/178 |
| 6,382,879 | B1 | * | 5/2002 | Bullivant | 405/256 |
| 6,420,014 | B1 | | 7/2002 | Hartman | 428/156 |
| D464,441 | S | * | 10/2002 | Luaces | D25/114 |
| 6,758,634 | B2 | * | 7/2004 | Nickelson et al. | 405/129.55 |
| 2002/0028114 | A1 | * | 3/2002 | Whitson | 405/284 |
| 2002/0107428 | A1 | | 8/2002 | Nickelson et al. | 588/256 |

* cited by examiner

*Primary Examiner*—Tara L. Mayo
(74) *Attorney, Agent, or Firm*—MacMillan, Sobanski & Todd, LLC

(57) ABSTRACT

An elongated sheet piling panel has a length and width, and opposed side edges, and has elongated voids positioned within the interior of the panel. The voids are oriented in the direction of the length of the panel, and the edges of the panel are configured to be connected to the edges of additional similar panels.

25 Claims, 4 Drawing Sheets

SHEET PILING PANELS WITH ELONGATED VOIDS

RELATED APPLICATIONS

This application claims priority from U.S. Provisional Patent Application Ser. No. 60/529,712, filed Dec. 15, 2003, and entitled SHEET PILING PANELS WITH ELONGATED VOIDS.

TECHNICAL FIELD

This invention relates to sheet piling material and to methods of making sheet piling. More particularly, this invention relates to sheet piling panels of the type that can be driven into the ground and connected to other similar panels to form a wall system, such as a sea wall or a retaining wall.

BACKGROUND OF THE INVENTION

Sheet piling material, or sheet piling, is used to form continuous earth retaining walls or sea walls. Some of the uses of such walls include anchored bulkheads, shore-protection walls, soil retaining walls, water-control structures, cut-off walls to control ground water or hazardous chemical seepage, and trenching. The retaining walls or sea walls are typically formed by driving the elongated, planar sheet piling material vertically into the ground, with adjacent sheets being joined to each other to form a sturdy structure. The sheets are typically driven into the ground by pile driving, and the sheets must have sufficient stiffness to withstand the pile driver without buckling or otherwise failing.

Usually, the sheet piling material has a panel side edge configuration that enables interlocking of the panel edges with the edge of an adjacent panel. Sheet pilings can be made of many different types of material, including steel, aluminum, treated timber, extruded vinyl sheet material, and fiber-reinforced pultruded polymer material. Sheet pilings are used in different cross-sectional configurations, such as Z-shaped, U-shaped, and arch-shaped configurations, as well as a straight flat configuration. There are currently more than ten US-based and international steel sheet piling manufacturers who produce nearly 200 different sheet piling configurations.

Steel pilings are widely used for sheet piling material due to the superior strength and ductility of steel, the efficient use of the material in various cross-sectional configurations, and the ease of installation due to interlocking. However, there are two major drawbacks to using steel: corrosion and high weight. An alternative to steel is aluminum. While more corrosion-resistant than steel, aluminum sheet pilings are more expensive than steel. Another choice for sheet pilings is preservative-treated timber. While timber retaining structures are less expensive than metallic systems, they are coming under increased environmental scrutiny because of the preservatives used in the timber. Extruded vinyl sheet pilings can also be used for sheet pilings. The vinyl pilings are more durable that either the steel or the wood pilings, but they are expensive and suffer problems related to low strength and low stiffness. Pultruded fiber-reinforced polymer sheet pilings are stronger and stiffer than their extruded counterparts, but are more expensive.

The predominantly-used steel piles are typically made using hot rolling or cold forming, although other methods can be used. Hot rolled panels are produced by a steel hot-mill procedure in which the shape is reduced during a series of rolling stages to the final form. The thickness of flanges and webs can be adjusted and interlocks that connect one sheet pile to the other are shaped by the flow of hot metal. The shape of cold formed sheet piles is obtained by passing cold sheet steel through a series of rolls. The interlock is formed, for example, by bending the flange ends into a hook-and-grip cross-sectional configuration or a male-female ball and socket joint configuration. While there is no standard interlock design, interlocks are usually designed to provide a permanent connection of individual sheets in order to form a continuous, relatively water-tight or earth-tight wall, and to allow reasonably free sliding to facilitate installation. Also, the sheet piling material is designed to provide adequate pull strength in applications where the sheet material is under tension, and to provide a certain amount of swing.

It would be advantageous if there could be developed an improved sheet piling material, taking into consideration such factors as structural strength requirements, cost, ease of installation, durability, and absence of environmental problems.

SUMMARY OF THE INVENTION

The above objects as well as other objects not specifically enumerated are achieved by an elongated sheet piling panel having a length and width, and opposed side edges, and having elongated voids positioned within the interior of the panel, with the voids being oriented in the direction of the length of the panel, and the edges of the panel being configured to be connected to the edges of additional similar panels.

According to this invention there is also provided a plurality of elongated sheet piling panels connected into a sheet piling wall, the sheet piling panels each having a length and width, and opposed side edges, and having elongated voids positioned within the interior of the panel, with the voids being oriented in the direction of the length of the panel, and the edges of each panel being connected to the edges of adjacent panels.

According to this invention there is also provided a method of installing sheet piling panels, including providing a plurality of elongated sheet piling panels having a length and width, and opposed side edges, and having elongated voids positioned within the interior of the panel. The voids are oriented in the direction of the length of the panel, and the edges of the panel are configured to be connected to the edges of additional similar panels, with the voids extending from end to end of the panel, thereby forming through passageways. The panels are installed while advancing a fluid through the voids, from end to end of the panels.

According to this invention there is also provided a method of installing sheet piling panels, including providing a plurality of elongated sheet piling panels having a length and width, and opposed side edges. The panels have elongated voids positioned within the interior of the panel, with the voids being oriented in the direction of the length of the panel. The edges of the panel are configured to be connected to the edges of additional similar panels. The panels are aligned during installation by inserting an alignment protrusion into the voids of the panels.

Various objects and advantages of this invention will become apparent to those skilled in the art from the following detailed description of the preferred embodiment, when read in light of the accompanying drawings.

DETAILED DESCRIPTION OF THE INVENTION

Figure 1:
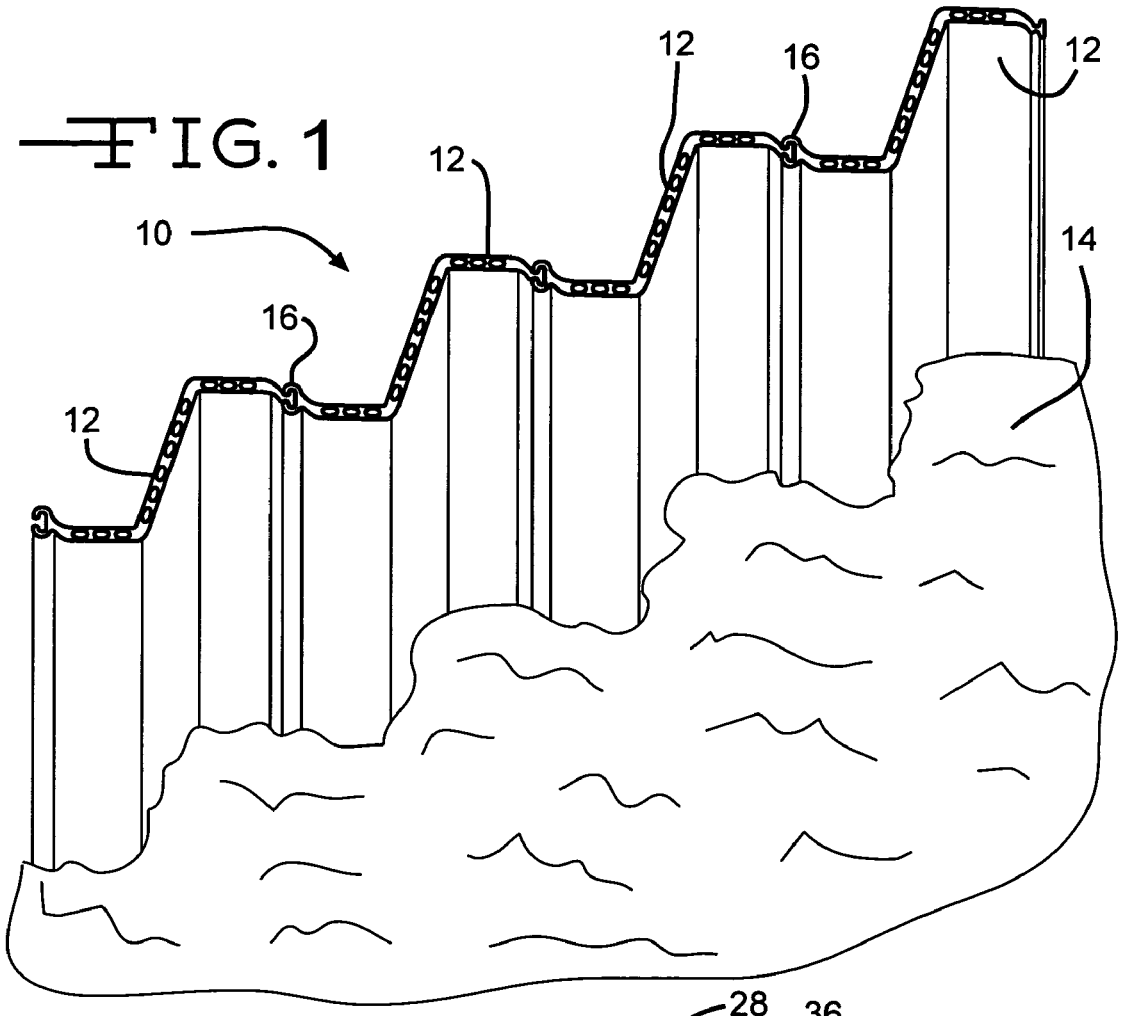
FIG. 1 is a schematic view in perspective of a sheet piling wall made from a plurality of elongated sheet piling panels.

As shown in FIG. 1, a sheet piling wall 10 is comprised of a plurality of sheet piling panels 12 connected together and driven into the ground to form a barrier for a body of water 14. The panels 12 are joined together at joints 16. The panels 12 shown have a Z-shaped cross-section, but it is well known that sheet piling walls can be made of panels having many different cross-sectional shapes. Typical sheet piling panels have folds or angles to provide non-linear cross-sections for increased stiffness, but the panels can be substantially planar.

Figure 2:
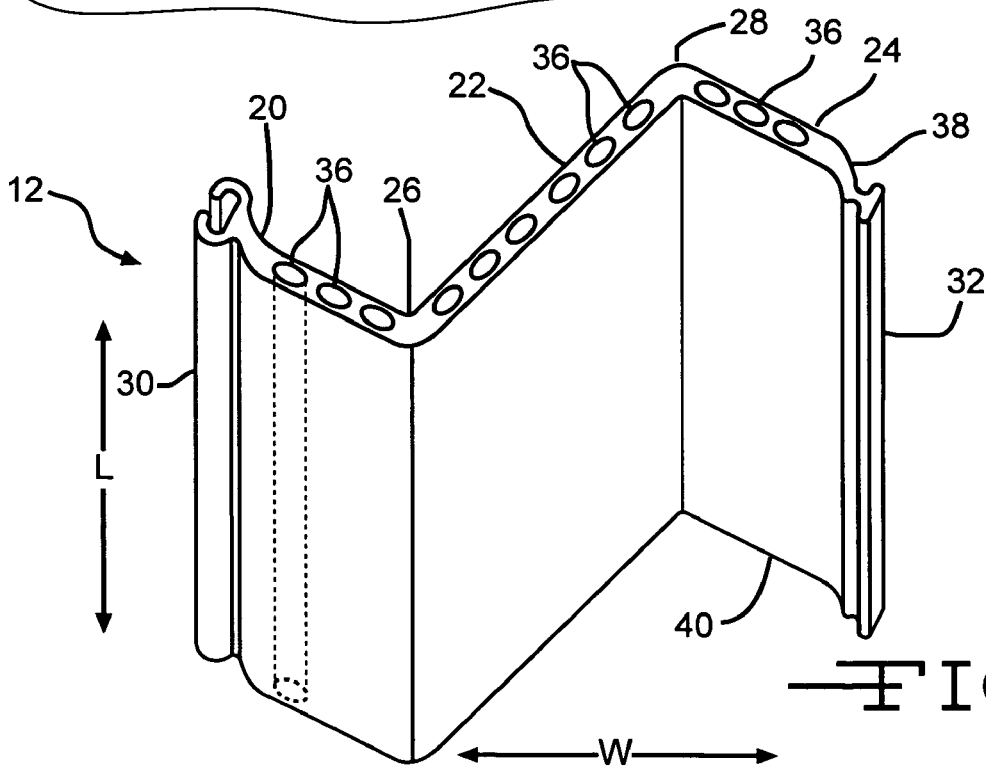
FIG. 2 is a schematic view in perspective of a Z-shaped sheet piling panel.
Figures 3, 4:
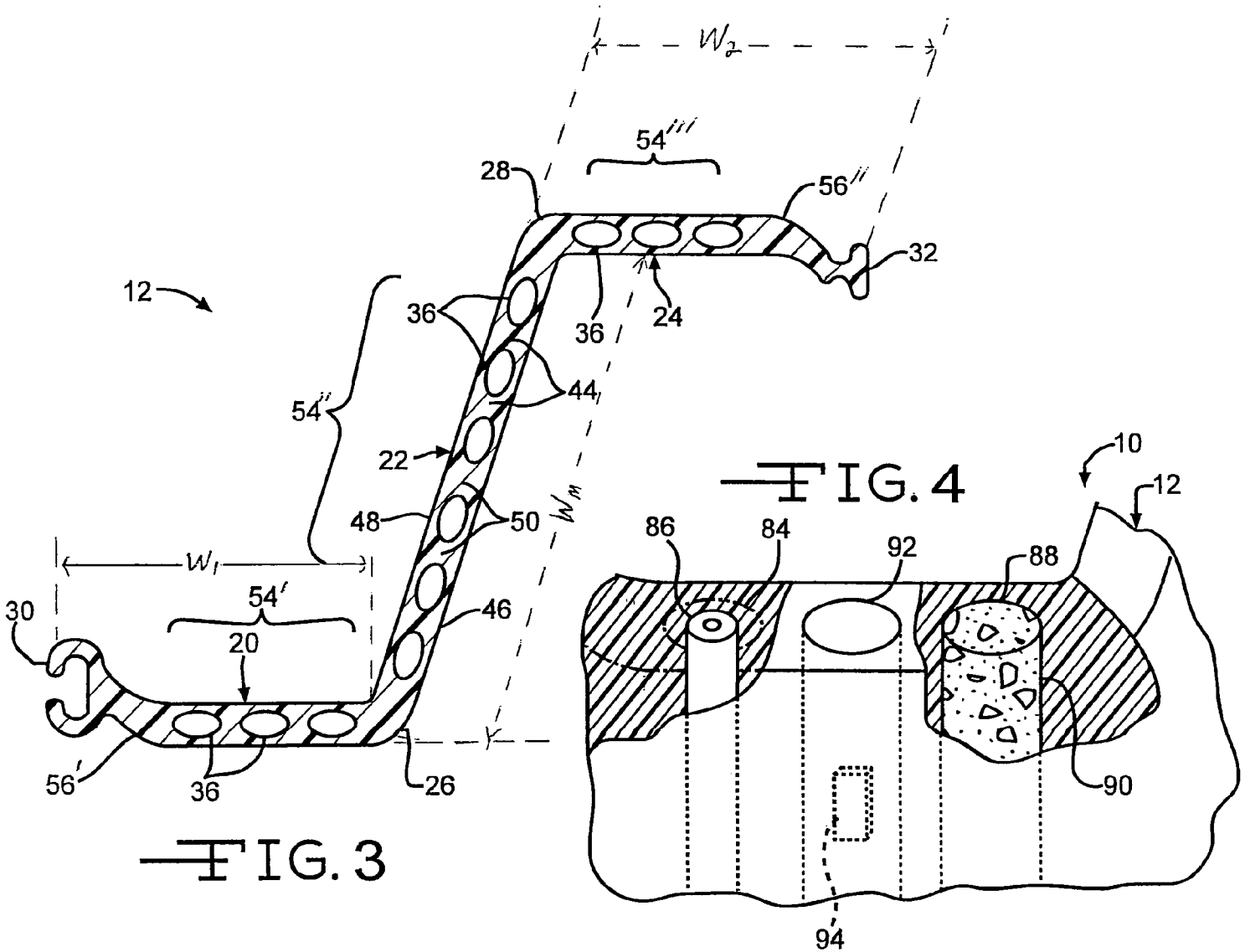
FIG. 3 is a schematic cross-sectional plan view of the sheet piling panel of FIG. 2.
FIG. 4 is a partially cut away schematic view in perspective of the sheet piling panel of FIG. 2.

As shown in FIG. 2, the Z-shaped sheet piling panel 12 is comprised of intersecting elongated wall segments 20, 22 and 24. As shown in FIG. 3, each wall segment 20, 22, 24 has a width. $W_1$, Wm and $W_2$, respectively. The wall segments 20, 22, and 24 are joined to each other at intersections 26 and 28. The sheet piling panel 12 has a length L much greater than its width W, thereby making the sheet piling panel elongated. For example, the sheet piling panel 12 could have a length of 40 feet and a width of 1 foot, or could have a length of 6 feet and a width of 1 foot. The sheet piling panel has opposed side edges 30 and 32, with the edge 30 having a female configuration and the edge 32 having a male configuration so that they can be connected to the edges of other, similar panels 12 to form the sheet piling wall 10. Any type of interlock mechanism can be used at the joints 16.

As shown in FIGS. 2 and 3, the sheet piling panel 12 is provided with a plurality of elongated voids 36 extending from the top end 38 of the sheet piling panel to the bottom end 40 of the sheet piling panel. For purposes of clarity, only one of the voids 36 is shown in FIG. 2 as extending the entire length of the sheet piling panel, but it is to be understood that each void can extend the entire length of the elongated panel 12. Preferably the voids 36 extend the entire length of the sheet piling panel 12, and preferably the voids 36 are substantially continuous along the length of the panel. It is to be understood that the voids can be discontinuous. Also, the voids can be open at the bottom end 40, or alternatively, can be closed. The voids are preferably parallel to each other, but may be at different angles for specific applications.

It can be seen that the voids 36 are positioned within the interior 44 of the sheet piling panel 12 rather than on the front face 46 or rear face 48 of the sheet piling panel 12. By positioning the voids 36 in the interior 44 of the panel 12, an I-beam type structure can be created between adjacent voids 36. The front and rear faces 46, 48 form the flanges of the I-beam configuration, and the material 50 between adjacent voids 36 form the column linking the flanges. The structure is similar to that of a truss. The areas of greatest stress on the sheet piling panel 12 during installation and operation of the panel are at the front and rear surfaces 46, 48, whereas the interior portion 44 of the sheet piling panel 12 is not subjected to the same amount of stress. Furthermore, the spacing between cells can be designed to optimize strength, stiffness and drivability. By positioning the voids 36 in the place where the stress is the lowest, savings in material can be realized without sacrificing overall stiffness and strength properties. The use of the voids 36 in the low stress area, i.e., interior portion 44, not only saves the cost of the removed material that would otherwise been in the interior 44 of the panel, but also reduces the weight of the panel without sacrificing overall strength or stiffness. The spacing between the voids 36 can be designed or configured as needed to optimize the strength, stiffness and driveability of the sheet piling panels for particular structural requirements.

Preferably, the voids are concentrated in the middle portions 54 of the sheet piling panel 12 (the middle portions 54', 54",54'" of the segments 20 22 24,), rather than in the edge portions 56', 56" of the panel 12 or in the intersection portions 26, 28. By configuring the panel 12 with the voids 36 present in the middle portions 54', 54", 54'" of each wall segment 20, 22, 24, and with an absence of voids 36 in the edge portions 56', 56" and intersections 26, 28 of the wall segments, the areas of greatest stress will be substantially void-free for improved structural integrity. It can be seen that by selecting where the elongated voids 36 are positioned within the sheet piling panels 12, the panels can be made stronger, and without increasing the amount of material or weight. For example, in a particular embodiment of the invention, the panel 12 has one or more voids 36 in the middle wall segment 22, and has none of the voids 36 in the flange wall segments 20 and 24. Other configurations with advantageous void placement can be used.

The sheet piling panels 12 can be made of any suitable material, including welded steel and aluminum. Preferably the sheet piling panel is made of a polymeric material. In one particular embodiment of the invention the sheet piling panels 12 are made using an extrusion process, with the voids 36 being created continuously as the panel is extruded. Although any extrudable material can be used, a preferred material is a thermoplastic material, and more preferably a vinyl material. Wood/plastic composites can also be extruded to make the sheet piling panels. In another particular embodiment of the invention the sheet piling panels 12 are made using a pultrusion process, with the voids 36 being created continuously as the panel is pultruded. Although any material capable of being pultruded can be used, a preferred material is a thermosetting resin, such as a polyester material.

It is to be understood that the sheet piling panels 12 can be provided with external reinforcement material. For example, fiber-reinforced polymer composite material can be applied directly to the sheet piling panels to augment the bending strength and bending stiffness. Preferably, this external reinforcement material is applied to the areas needing additional strengthening, such as, for example, at the top and bottom exterior surfaces of the panels 12. Other reinforcement materials can be used.

Regardless of how the panels are formed, if they are of a polymeric material they can be filled with any suitable filler, and can be reinforced with any suitable reinforcement material. Fillers and reinforcements suitable for filling and reinforcing polymeric materials for use in extrusion and pultrusion processes are well known to those skilled in the art. Examples include, but are not limited to, sawdust, natural fillers such as hemp or flax, chopped glass fibers, continuous glass fibers, glass mats, and glass fabrics.

Figure 5:
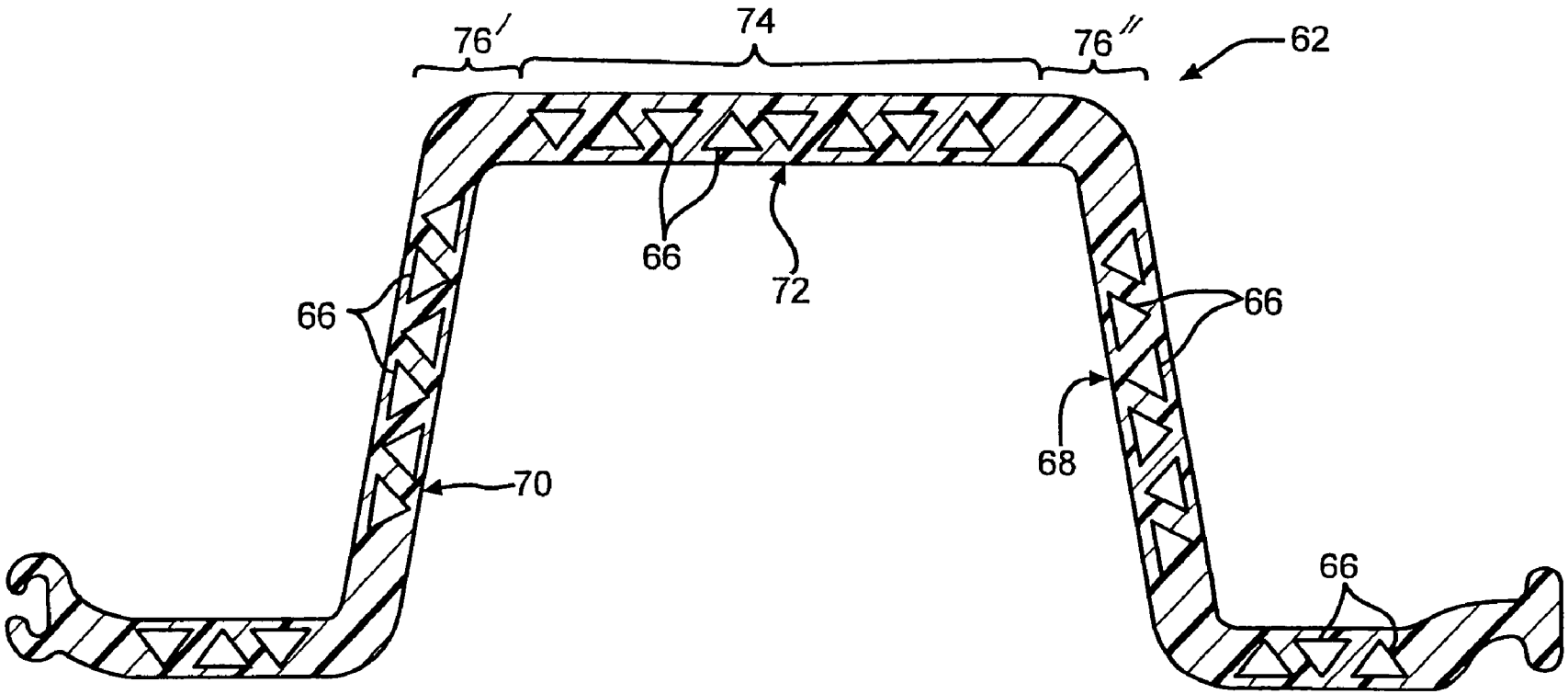
FIG. 5 is a schematic cross-sectional plan view of a U-shaped sheet piling panel.

As shown in FIG. 5, a different embodiment of the sheet piling panel is indicated at 62, and the voids 66 of the sheet piling panel 62 are not oval in cross-sectional shape as shown in FIGS. 2 and 3, but rather have triangular cross-sectional shapes. Many other cross-sectional shapes can be used, such as, for example, quadrilateral, pentagonal, hexagonal, circular and elliptical cross-sectional shapes. Combinations of different cross-sectional shapes can be used in the same sheet piling panel 12, as desired for different structural requirements. Also, the shapes can vary along the length of the elongated sheet piling 62 as needed for structural considerations. The sheet piling panel 62 has a U-shaped configuration with two primary side wall segments 68 and 70, and a top wall segment 72. The middle portion 74 of the top wall 72 of the sheet piling panel 62, containing the voids 66, is positioned between first and second edge portions 76', 76" of the top wall 72, with the first and second edge portions 76', 76" containing none of the voids 66. The proportion of the length of the middle portion 74 to the entire length of the top wall 72 (middle portion 74 plus the first and second edge portions 76', 76") can be any proportion suitable to assure adequate strength of the panel 62 at the first and second edge portions 76', 76". In a preferred embodiment, the proportion is within the range of from about 50 percent to about 80 percent.

As shown in FIG. 4, various materials can be placed in the voids of the connected elongated sheet piling panels 12 for desirable advantages. For example, void 84 is shown as being fitted with a reinforcement member 86, made of steel or a polymer reinforcement material, or of other suitable material to increase stiffness or strength of the panel 12. Void 88 can be filled with concrete 90 or any other desirable substance to affect the properties of the panel 12 and the sheet piling wall 10. Void 92 is provided with a sensor, indicated at 94, for monitoring conditions of the panel 82 and the sheet piling wall 10. Examples of sensors that could be used include a sensor for measuring the structural characteristics, such as the localized strain of the panel, or sensors for measuring such environmental conditions as the temperature in the void or the presence of water, other liquids, or specific chemical substances in the void. The sensors can be connected to monitors or data receivers by any suitable means, not shown, such as by transmitters, wires or optical cables. Although only one void 92 is shown as including a sensor 94, any number of sensors can be used, and they can be placed in any number of voids as desired.

Figure 6:
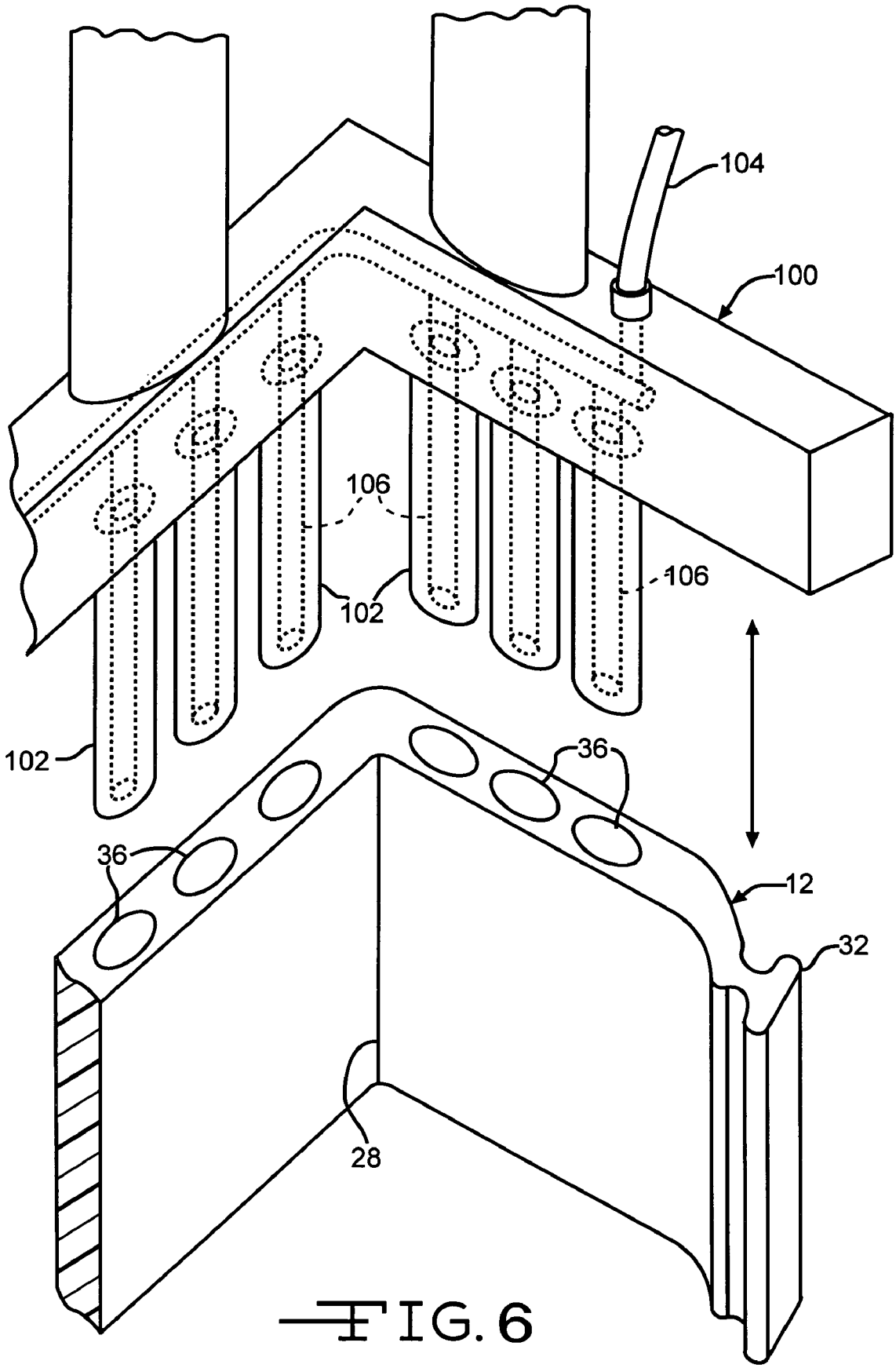
FIG. 6 is a schematic view of the sheet piling panel of FIG. 2 in combination with a pile driver for driving the sheet piling panel into the ground.

As shown in FIG. 6, the sheet piling panel 12 can be driven into the ground by means of a pile driver 100. Pile drivers are well known. However, where the sheet piling panel 12 is provided with voids 36, the pile driver can be provided with alignment protrusion 102 which can be inserted into the voids 36 during the pile driving operation to maintain the proper alignment. The alignment protrusions 102 can be of any length and shape suitable for keeping the panels 12 in alignment with the pile driver 100. It is unnecessary for there to be the same number of alignment protrusions 102 as the number of voids. All that is required is a number of alignment members sufficient for alignment. Examples of alignment members in combination with the pile driver include a fork-shaped hammer head and a nose fixture.

One of the benefits of providing the sheet piling panel 12 with the voids extending from end-to-end of the panel, thereby forming through passageways, is that a drilling fluid can be pumped through one or more of the voids to assist in driving the sheet piling panel 12 into the ground. The fluid can be a drilling mud, or air, as well as other materials. Other types of fluids, such as protective fluids or anchoring fluids can also be pumped through the voids. One method of pumping the drilling fluid through the voids is shown in FIG. 6, where a conduit 104 is supplied with the drilling fluid under pressure, and is fed through branch conduits 106 and through the alignment protrusions 102 and into the voids 36. It may be advantageous, when pumping drilling fluid through one or more of the voids, to line or reinforce the walls of the void with a high strength conduit or liner to be withstand the pressure of the drilling fluid. Such a liner can be made of any suitable material, such as a high density polypropylene material reinforced with glass fibers.

The sheet piling panels made according to the invention can be used to make sheet piling walls for such uses as sea-walls, anchored bulkheads, shore-protection walls, soil retaining walls, water-control structures, cut-off walls to control ground water or hazardous chemical seepage, and trenching, as well as other uses.

The principle and mode of operation of this invention have been described in its preferred embodiments. However, it should be noted that this invention may be practiced otherwise than as specifically illustrated and described without departing from its scope.

What is claimed is:

1. An elongated sheet piling panel having a length and width, and opposed side edges, the panel comprising:

a first flange wall segment:

a second flange wall segment; and a middle wall segment between said first and second wall segments, said first and second flange wall segments and said middle wall segment defining a substantially Z-shaped cross section:

wherein at least the middle wall segment has elongated voids positioned within an interior of the panel, said voids being oriented in the direction of the length of the panel, and wherein said middle wall segment is comprised of spaced apart front and rear surfaces, and wherein said middle wall segment has material between adjacent voids, with the material between adjacent voids linking said front and rear surfaces, thereby forming an I-beam configuration, and wherein said middle wall segment has a width greater than a width of one of said first flange wall segment and said second flange wall segment;

and wherein said side edges of the panel are configured to be connected to the edges of additional similar panels.

2. The elongated panel of claim 1, wherein the voids have a quadrilateral cross-sectional shape.

3. The elongated panel of claim 2, wherein the voids have a rectangular cross-sectional shape.

4. The elongated panel of claim 1, wherein said middle wall segment includes:

a first edge portion adjacent the intersection of said middle wall segment and said first flange wall segment, said first edge portion containing no voids:

a second edge portion adjacent the intersection of said middle wall segment and said second flange wall segment, said second edge portion containing no voids; and a middle portion between said first and second edge portions, said middle portion containing said voids, the proportion of a width of said middle portion to the entire width of said middle wall segment being within the range of from about 50 percent to about 80 percent.

5. The elongated panel of claim 1, wherein said elongated voids are positioned within the interior of said middle wall segment, said first and second flange wall segments have no voids therein.

6. The elongated panel of claim 1, wherein said voids are configured to receive an alignment protrusion.

7. The elongated panel of claim 1, wherein the first and second wall segments have elongated voids positioned within an interior of the panel, said voids being oriented in the direction of the length of the panel.

8. The elongated panel of claim 1 in which the panel includes an external reinforcement material.

9. The elongated panel of claim 1 including a sensor in one of the voids for monitoring conditions of the panel.

10. The elongated panel of claim 9 in which the sensor is a sensor for measuring the structural characteristics of the panel.

11. A plurality of elongated sheet piling panels connected into a sheet piling wall, where the sheet piling panels are of the type defined in claim 1, and wherein at least some of the voids of some of the sheet piling panels are provided with a reinforcement material.

12. The plurality of elongated sheet piling panels of claim 11 including a sensor in one of the voids for monitoring conditions of the panels.

13. An elongated sheet piling panel having a length and width, and opposed side edges, the panel comprising:

a first flange wall segment;

a second flange wall segment; and a middle wall segment between said first and second wall segments, said first and second flange wall segments and said middle wall segment defining a non-linear shaped cross section, said middle wall segment having a width greater than a width of one of said first flange wall segment and said second flange wall segment;

wherein at least the middle wall segment has elongated voids positioned within an interior of the panel, said voids being oriented in the direction of the length of the panel, and wherein said middle wall segment is comprised of spaced apart front and rear surfaces, and wherein said middle wall segment has material between adjacent voids, with the material between adjacent voids linking said front and rear surfaces, thereby forming an I-beam configuration;

and wherein said side edges of the panel are configured to be connected to the edges of additional similar panels.

14. The elongated panel of claim 13, wherein the voids have a quadrilateral cross-sectional shape.

15. The elongated panel of claim 13, wherein the voids have a rectangular cross-sectional shape.

16. The elongated panel of claim 13, wherein said middle wall segment includes:

a first edge portion adjacent the intersection of said middle wall segment and said first flange wall segment, said first edge portion containing no voids;

a second edge portion adjacent the intersection of said middle wall segment and said second flange wall segment, said second edge portion containing no voids; and a middle portion between said first and second edge portions, said middle portion containing said voids, the proportion of a width of said middle portion to the entire width of said middle wall segment being within the range of from about 50 percent to about 80 percent.

17. The elongated panel of claim 13, wherein said elongated voids are positioned within the interior of said middle wall segment, said first and second flange wall segments have no voids therein.

18. The elongated panel of claim 13, wherein said voids are configured to receive an alignment protrusion.

19. The elongated panel of claim 13 wherein the first and second wall segments have elongated voids positioned within an interior of the panel, said voids being oriented in the direction of the length of the panel.

20. The elongated panel of claim 13 in which the panel includes an external reinforcement material.

21. The elongated panel of claim 13 including a sensor in one of the voids for monitoring conditions of the panel.

22. The elongated panel of claim 21 in which the sensor is a sensor for measuring the structural characteristics of the panel.

23. A plurality of elongated sheet piling panels connected into a sheet piling wall, where the sheet piling panels are of the type defined in claim 13, and wherein at least some of the voids of some of the sheet piling panels are provided with a reinforcement material.

24. The plurality of elongated sheet piling panels of claim 23 including a sensor in one of the voids for monitoring conditions of the panels.

25. An elongated sheet piling panel having a length and width, and opposed side edges, the panel comprising:

a first flange wall segment;

a second flange wall segment; and a middle wall segment between said first and second wall segments, said first and second flange wall segments and said middle wall segment defining a substantially Z-shaped cross section;

wherein at least ,the middle wall segment has elongated voids positioned within ,an interior of the panel, said voids being oriented in the direction of the length of the panel, and wherein said middle wall segment is comprised of spaced apart front and rear surfaces, and wherein said middle wall segment has material between adjacent voids, with the material between adjacent voids linking said front and rear surfaces, thereby forming an I-beam configuration; and wherein said middle wall segment includes:

a first edge portion adjacent the intersection of said middle wall segment and said first flange wall segment, said first edge portion containing no voids;

a second edge portion adjacent the intersection of said middle wall segment and said second flange wall segment, said second edge portion containing no voids; and a middle portion between said first and second edge portions, said middle portion containing said voids, the proportion of a width of said middle portion to the entire width of said middle wall segment being within the range of from about 50 percent to about 80 percent; and wherein said side edges of the panel are configured to be connected to the edges of additional similar panels.

* * * * *